US007954260B2

(12) United States Patent
Enderson

(10) Patent No.: US 7,954,260 B2
(45) Date of Patent: Jun. 7, 2011

(54) INTERCHANGEABLE SANDAL AND RELATED METHODS

(76) Inventor: J. Patrick Enderson, Olney, MD (US)

( * ) Notice: Subject to any disclaimer, the term of this patent is extended or adjusted under 35 U.S.C. 154(b) by 921 days.

(21) Appl. No.: 11/896,601

(22) Filed: Sep. 4, 2007

(65) Prior Publication Data

US 2008/0060227 A1 Mar. 13, 2008

Related U.S. Application Data

(60) Provisional application No. 60/842,673, filed on Sep. 7, 2006.

(51) Int. Cl.
*A43B 3/24* (2006.01)

(52) U.S. Cl. ..... 36/101; 36/11.5

(58) Field of Classification Search ..... 36/101, 36/11.5, 50.1, 100

See application file for complete search history.

(56) References Cited

U.S. PATENT DOCUMENTS

| | | | | |
|---|---|---|---|---|
| 1,236,350 | A | 8/1917 | Pougher | |
| 4,060,918 | A | 12/1977 | Mandel | |
| 4,172,330 | A | 10/1979 | Kao | |
| 4,616,431 | A | 10/1986 | Dassler | |
| 5,060,400 | A * | 10/1991 | Finn et al. | 36/12 |
| 5,379,491 | A | 1/1995 | Solo | |
| 5,896,684 | A * | 4/1999 | Lin | 36/101 |
| 6,256,798 | B1 | 7/2001 | Egolf et al. | |
| 6,418,643 | B1 * | 7/2002 | Yang | 36/101 |
| 6,430,846 | B1 * | 8/2002 | Lin | 36/101 |
| 6,442,870 | B1 * | 9/2002 | Tsai | 36/11.5 |
| 6,640,373 | B2 * | 11/2003 | Tsai | 12/142 S |
| 2003/0145490 | A1 * | 8/2003 | Tsai | 36/15 |

* cited by examiner

*Primary Examiner* — Ted Kavanaugh
(74) *Attorney, Agent, or Firm* — Nixon & Vanderhye P.C.

(57) ABSTRACT

Various embodiments of an evolutionary interchangeable sandal are disclosed. Certain example embodiments described herein relate to various sandal configurations that utilize at least two main elements, including a platform sole base and a strap assembly. These elements may be joined by special fasteners that provide quick-connect or disconnect while securely maintaining sandal integrity and wearability. The platform sole base may be customized in various thicknesses and sandal sizes. The strap assembly may be customized in various shapes, colors, styles, and/or manufacturing materials. In the case of the sole tread/height enhancement addition, the soles tread and height may be interchanged as needed.

22 Claims, 9 Drawing Sheets

INTERCHANGEABLE SANDAL AND RELATED METHODS

CROSS-REFERENCE TO RELATED APPLICATION

This application claims the benefit of U.S. provisional patent application No. 60/842,673, filed on Sep. 7, 2006, the entire content of which is hereby incorporated herein by reference.

FIELD OF THE INVENTION

Certain example embodiments described herein relate to several distinct unassembled elements which, when assembled, comprise a functional, updatably fashionable, and interchangeable sandal. More particularly, certain example embodiments described herein relate to various sandal configurations that utilize at least two main elements, including a platform sole base and a strap assembly. These elements may be joined by special fasteners assuring quick-connect or disconnect while securely maintaining sandal integrity and sandal sizes. The strap assembly may also be customized to various thicknesses and/or sandal sizes. The strap assembly may also be customized in various shapes, colors, styles, and/or manufacturing materials while maintaining universal fasteners for its unique connection to the platform sole base. Additional sole assemblies may also be attached to create various treads and/or sole height enhancements as desired.

BACKGROUND AND SUMMARY OF EXAMPLE EMBODIMENTS OF THE INVENTION

In order to manufacture sandals able to maintain up-to-date fashionable features necessary to satisfy an ever-changing customer demand, manufacturers have to supply a significantly high number of sandals (or flip flops) with different styles at all times. For most of these sandal configurations, the sole platform remains the same while the top part (e.g., strap assembly) is changed in terms of colors, styles, and/or manufacturing materials. The cost and environmental impact of this approach is significant as customer demand, often driven by seasonal style changes, is often unpredictable. From a customer standpoint, matching colors, styles, and/or manufacturing materials with other wearable items (e.g., purses, dresses, hair accessories, etc.) often implies the possession of multiple sandals, each with different features. Furthermore, most often, highly fashionable and expensive sandals may not be used in harsher environments including, for example, in the presence of sand and/or water.

Therefore, it will be appreciated that it would be beneficial to provide a single sandal sole platform that could easily be connected to a variety of the most current fashion driven style strap assemblies. With this design arrangement, the user could carry various strap assemblies in her/his purse or pack, for example, making a transformation of the sandal convenient, quick, and easy whenever such a desired change were deemed proper or necessary, in various kinds of environments and/or events. For example, while the sole platform remains the same, a particular top sandal portion, or strap assembly, with desired colors (e.g., matching a bathing suit), styles, and/or manufacturing materials may be suited for a walk on the beach, whereas a short period later, another strap assembly with different colors, styles, and/or manufacturing materials may be easily substituted for a trip back to the office or to another more formal atmosphere.

Current interchangeable sandal designs attempt to address the consumer desire for style changes to the sandal, but are complex, not aesthetically pleasing, not functionally sound, and do not address the issue of the interlocking mechanisms being susceptible to water, sand, and/or other debris.

Current interchangeable sandal designs incorporate complex mechanisms such as that described in U.S. Pat. No. 5,836,090, and are difficult to manufacture and even more difficult to keep free of sand and/or debris, and are not water tight. They employ latches that are susceptible to corrosion from water and deterioration from sand and/or other debris that may enter into the latching assembly itself, thus compromising the assembly's integrity and making the sandal inherently unsafe for the user, for example, by increasing the possibility of an unwanted strap release. Still others designs, including those disclosed in U.S. Pat. No. 4,172,330, show a "flip flop" sandal design where the upper straps are detachable from the sole but incorporate small separated attachment pieces that do not provide reliable attachments and make the straps difficult to change. The techniques described in U.S. Pat. No. 7,028,420 incorporate a single strap feed-through, and the sole and are joined at a point above the user's foot at the highest stress point of the sandal assembly. This design unfortunately only provides a single linear style broad strap, which does not address current market trends and is also susceptible to sand and/or debris entering into the sole's receiving slot.

Thus, it will be appreciated that there exists a need in the art to overcome one or more of these and/or other disadvantages, and/or to provide a single sandal sole platform that can easily be connected to a variety of the most current fashion driven style strap assemblies.

One aspect of certain example embodiments of this invention relates to providing a more efficient, "always-in-style" evolutionary and interchangeable sandal configuration that allows the user to utilize one single sole platform and as many customized strap assemblies as desired, at a lower cost and with ease of use.

Another aspect of certain example embodiments relates to utilizing the combination of at least two main sandal portions, including a platform sole base and a strap assembly easily connected to said platform sole base.

Still another aspect of certain example embodiments relates to a complete sandal configuration that can be worn in substantially all environmental conditions, as it includes substantially water-tight fasteners. In certain example embodiments, the sandal may include a strap assembly equipped with special substantially water-sand-dust-proof fasteners that connect the strap assembly to the sandal sole base, interchangeable tread, and/or an adjustable strap assembly size so that the sandal fits feet having the same shoe size but differing shoe widths.

In certain example embodiments, the sandal may be configured such that the strap assembly itself is substantially water-proof, while the tread is made of an anti-slip material, for example, those utilized in applications on boats or in harsh environments. Additionally, in certain example embodiments, a sole height enhancer assembly may be added to increase the overall thickness of the sole itself.

According to certain example embodiments, a sandal is provided. A platform sole base includes at least one positioning port formed therein. At least one first fastener assembly is provided. Each said first fastener assembly comprises a first locking structure (e.g., which may be substantially cylindrical), a dampening system (e.g., which may be substantially cylindrical) insertable into the first locking structure, and at least two locking arms that extend inwardly into the first locking structure from the inner walls thereof. A strap assembly includes a strap and at least one second fastener assembly. Each said second fastener assembly comprises a second locking structure (e.g., which may be substantially cylindrical) insertable into the first locking structure, at least two locking pins extending outwardly from the bottom of the second locking structure for rotatably engaging/disengaging with the at least two locking arms, and at least one strap receiving port for receiving the strap. A strap locking system cooperates with the at least one strap receiving port to secure the strap to the platform sole base. Each said first fastener assembly is respectively associated with one said positioning port. Each said first fastener assembly is respectively associated with one said second fastener assembly. The first and second fastener assemblies are suitable to removably connect the strap assembly to the platform sole base.

Optionally, the sandal may further comprise at least one wing fastener provided to the first fastener assembly proximate to the locking arms thereof and at least one receiving channel extending outwardly from the second locking structure proximate to the locking pins for rotatably engaging/disengaging with the at least one wing fastener.

According to certain other example embodiments, a sandal is provided. A platform sole base includes at least one positioning port formed therein. At least one first fastener assembly is provided. Each said first fastener assembly comprises a first locking structure (e.g., which may be substantially cylindrical), a dampening system (e.g., which may be substantially cylindrical) insertable into the first locking structure, and a substantially spiral-shaped channel formed on the first locking structure's inner surface. A strap assembly includes a strap and at least one second fastener assembly. Each said second fastener assembly comprises a second locking structure (e.g., which may be substantially cylindrical) insertable into the first locking structure, a substantially spiral-shaped groove for insertion into the channel of the at least one first locking structure, and at least one strap receiving port for receiving the strap. A strap locking system cooperates with the at least one strap receiving port to secure the strap to the platform sole base. Each said first fastener assembly is respectively associated with one said positioning port. Each said first fastener assembly is respectively associated with one said second fastener assembly. The first and second fastener assemblies are suitable to removably connect the strap assembly to the platform sole base.

According to certain other example embodiments, a sandal is provided. A platform sole base includes at least one positioning port formed therein. A strap is provided. Fastener assembly means removably connect the strap to the platform sole base at the at least one positioning port. Strap locking means secure the strap to the fastener assembly means.

In certain example embodiments, a method of making a sandal is provided. A platform sole base is provided. At least one positioning port is formed in the platform sole base. At least one first fastener assembly is provided, with each said first fastener assembly comprising a first locking structure, a dampening system insertable into the first locking structure, and at least one channel formed on the first locking structure's inner surface. There is provided a strap assembly including a strap and at least one second fastener assembly, each said second fastener assembly comprising a second locking structure insertable into the first locking structure, at least one protrusion for insertion into the at least one channel of the at least one first locking structure, and at least one strap receiving port for receiving the strap. A strap locking system is provided to cooperate with the at least one strap receiving port to secure the strap to the platform sole base. Each said first fastener is respectively associated with one said positioning port. Each said first fastener assembly is respective associated with one said second fastener assembly. The strap assembly is removably connected to the platform sole base via the first and second fastener assemblies.

These aspects and embodiments may be used separately or applied in various combinations in different embodiments of this invention.

BRIEF DESCRIPTION OF THE DRAWINGS

These and other features and advantages may be better and more completely understood by reference to the following detailed description of exemplary illustrative embodiments in conjunction with the drawings, of which.

DETAILED DESCRIPTION OF EXAMPLE EMBODIMENTS OF THE INVENTION

Figure 1:
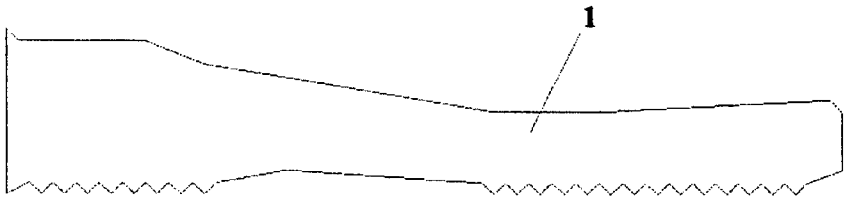
FIG. 1 and FIG. 2 are schematic illustrations of a treaded sandal sole base showing some simplified manufacturing steps in accordance with an example embodiment.
Figure 2:
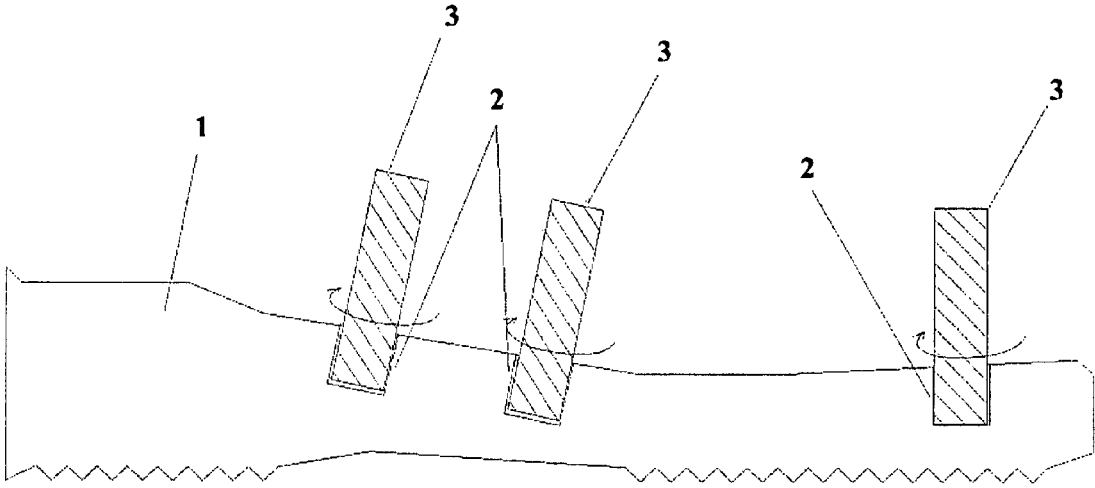

Referring now more particularly to the drawings in which like reference numerals indicate like parts throughout the several views, FIGS. 1 and 2 are schematic illustrations of a treaded sandal (or flip flop) sole base showing some simplified manufacturing steps in accordance with an example embodiment. The evolutionary interchangeable sandal system, according to an example embodiment of the invention, utilizes a sandal sole base 1 as shown in FIG. 1, which may include one or more positioning ports 2 as shown in FIG. 2. Ports 2 may be obtained in the manufacturing process indirectly through machining (e.g., via tools 3) or directly (e.g., via mold extrusion). Sole base 1 may be formed from any suitable material having sufficient flexibility for the correct movement of the foot.

Figure 3:
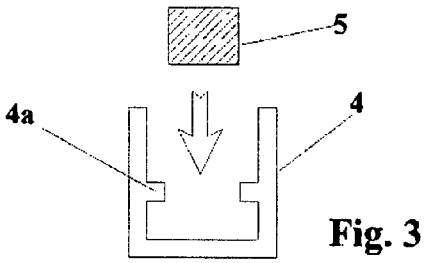
FIGS. 3, 3*a*, and 4 are schematic illustrations of illustrative fastener systems and their positioning within the sole base in accordance with an example embodiment.
Figure 3A:
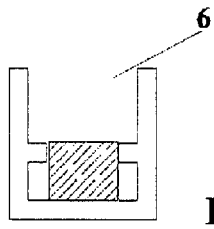

In FIG. 3, the fastener system is formed by a locking structure 4, locking mechanism (or locking arms) 4*a*, and a dampening system 5. The materials utilized to form the fastener system may be materials with sufficient strength to execute its locking function and maintain integrity of the strap assembly under the forces caused by walking and running. The dampening system 5 may be formed by a cylinder of flexible materials (e.g., silicon rubber), such that it executes a water tight seal within the locking pins 4*a*, while providing an upward spring action on the top portion of the fastener locking mechanism described in the following figures. Once the dampening and sealing system 5, is in place it forms structure 6 shown in FIG. 3*a*. In certain example embodiments, the locking structure 4 may be substantially cylindrically shaped (or may appear substantially U-shaped when viewed in cross-section), and the locking mechanism 4*a* may include two short locking arms that protrude inwardly into the cavity of the locking structure 4 when viewed in cross-section.

Figure 4:
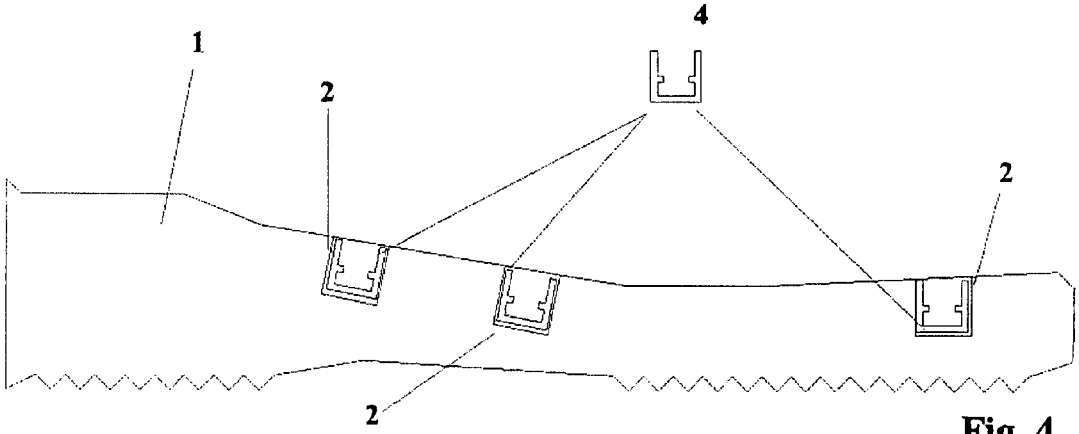

The elements of the fastener system described thus far can be secured (e.g., cemented) inside ports 2 within the sole base 1 as indicated in FIG. 4. It will be appreciated that the number of fastener systems utilized may be arbitrary. In FIG. 4, for example, the number shown is three, while the maximum number may vary according to the style and/or purpose of the top strap assembly described in the following drawing illustrations.

Figure 5:
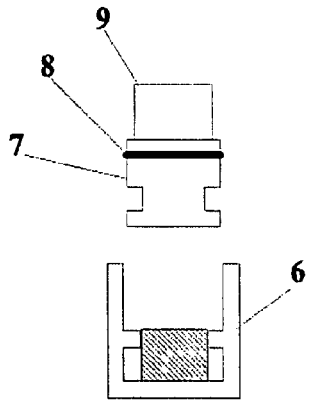
FIG. 5 and FIG. 6 are schematic illustrations showing elements of the fastener systems and their positioning within the sole base in accordance with an example embodiment.
Figure 6:
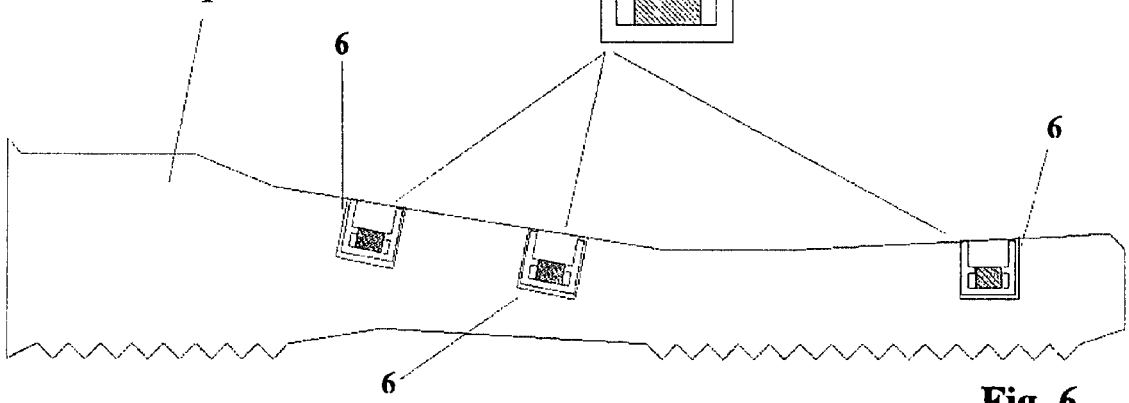

FIG. 5 illustrates the substantially impermeable locking principles of the fastener structure 6. The top portion of the fastener may be formed by structure 7, whose configuration accommodates provisions for an o-ring or other sealing configurations and a top portion 9 to which the strap assembly may be connected. FIG. 6 indicates the positioning of the fasteners within the sole base 1 in one example embodiment. It will be appreciated that the fasteners may be positioned elsewhere in certain other example embodiments.

Figure 7:
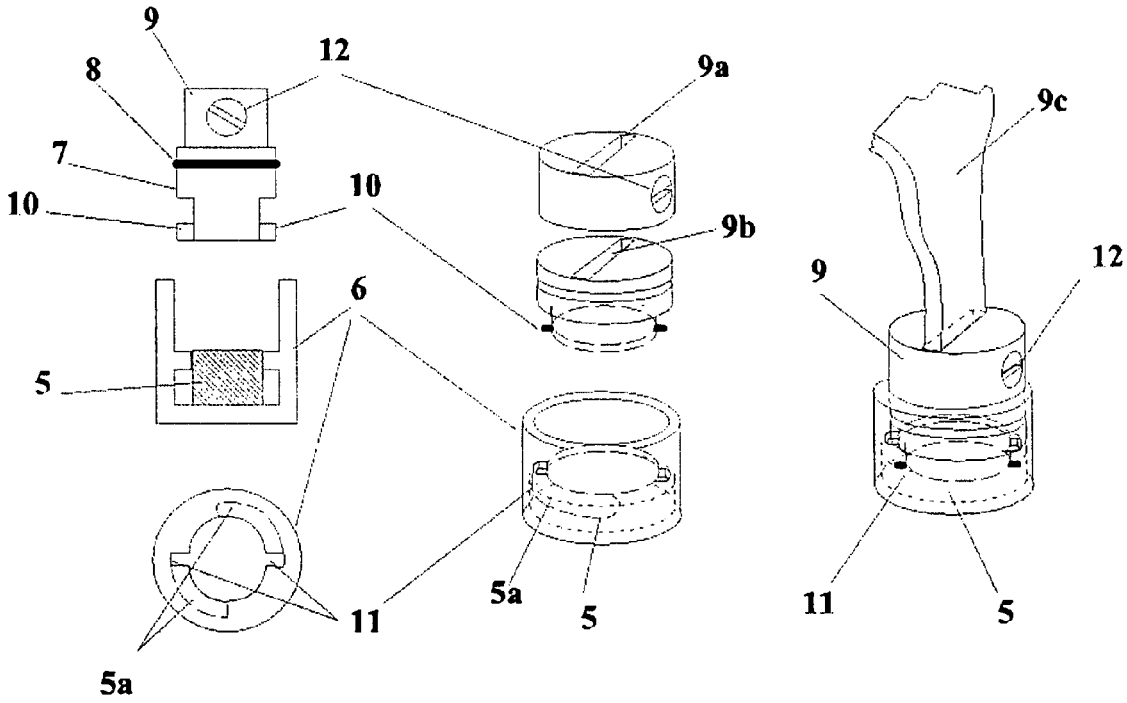
FIG. 7 includes cross-sectional and perspective views of an illustrative configuration of the fastener systems and their connections to the strap assembly, in accordance with an example embodiment.

FIG. 7 illustrates the sealed fastener mechanism completely assembled in accordance with an example embodiment. The top view of the fastener structure 6 shows a non-limiting configuration of the locking pin provisions 11 within which locking pins 10 included with structure 7 are inserted (e.g., by executing a mild pressure against the dampening and sealing system 5). Once locking pins 10 are pressed under the locking provisions 11, the whole structure can be rotated. Under the locking provisions 11, the shape of the inner portions of the locking structure 6 are such that the combined effect of the pressure executed by the dampening and sealing system 5 and the inner contour 5*a* of the locking structure 6 reduces the ability of the locking structure 7 to become disconnected. The top portions of the locking and sealing structure 7 include an o-ring and a portion 9 allowing adjustment of the strap assembly 9*c*. In this illustrative configuration, the strap assembly may be inserted within portion 9 through properly shaped ports 9*a* and 9*b*, wherein these portions form a complete piece forming structure 7.

Once the strap assembly is inserted within ports 9*a* and 9*b*, it can be adjusted to the desired length and secured through the locking system 12. This locking system may be formed by a screw and vice configuration or any other proper mechanism assuring a firm grip on the strap assembly 9*c*. Once the strap assembly length is adjusted and the sealing fastener is fully inserted inside structure 6, the overall configuration may be such that the whole locking fastener system is flashed with the surface of sole 1 and invisible.

Figure 8:
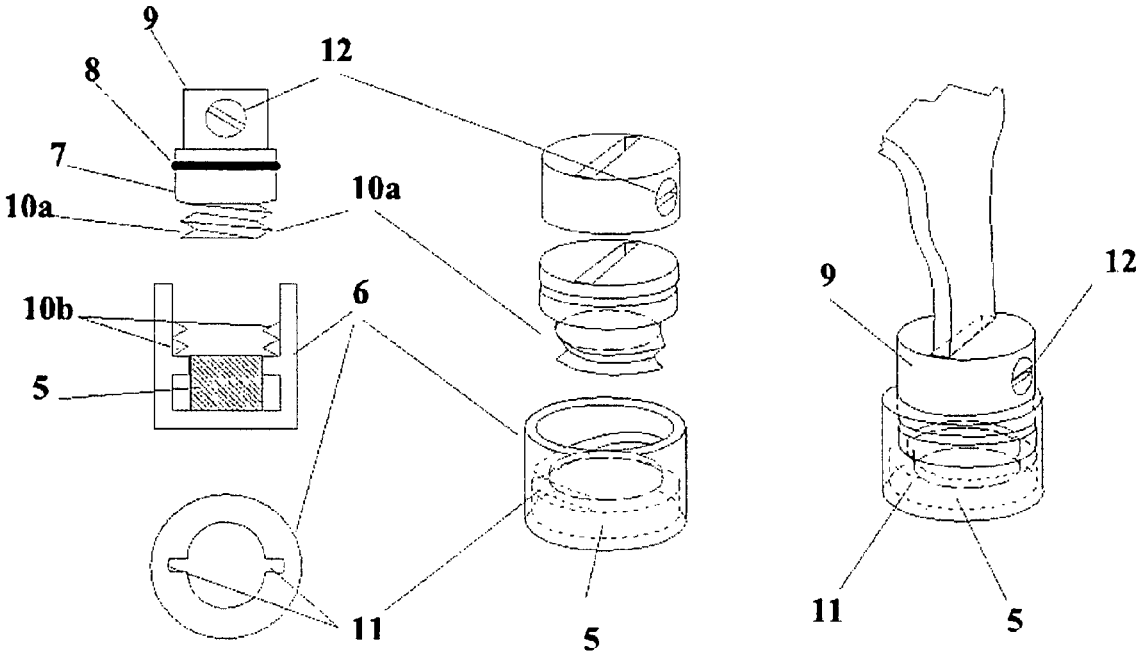
FIG. 8 includes cross-sectional and perspective views of another illustrative configuration of the fastener systems and their connections to the strap assembly, in accordance with an example embodiment.

FIG. 8 illustrates an alternative sealed fastener system within which locking pins 10 are replaced by a tread or interlocking grooves (e.g., substantially spiral-shaped grooves for insertion into a corresponding channel) kept in place and sealed by the dampening and sealing system 5 and the o-ring 8. In this illustrative configuration, the top portion of the fastener can be inserted, rotated, and sealed into position within structure 6 embedded within sole 1 as indicated in FIGS. 1, 4, 6, 9, and 11.

Figure 9:
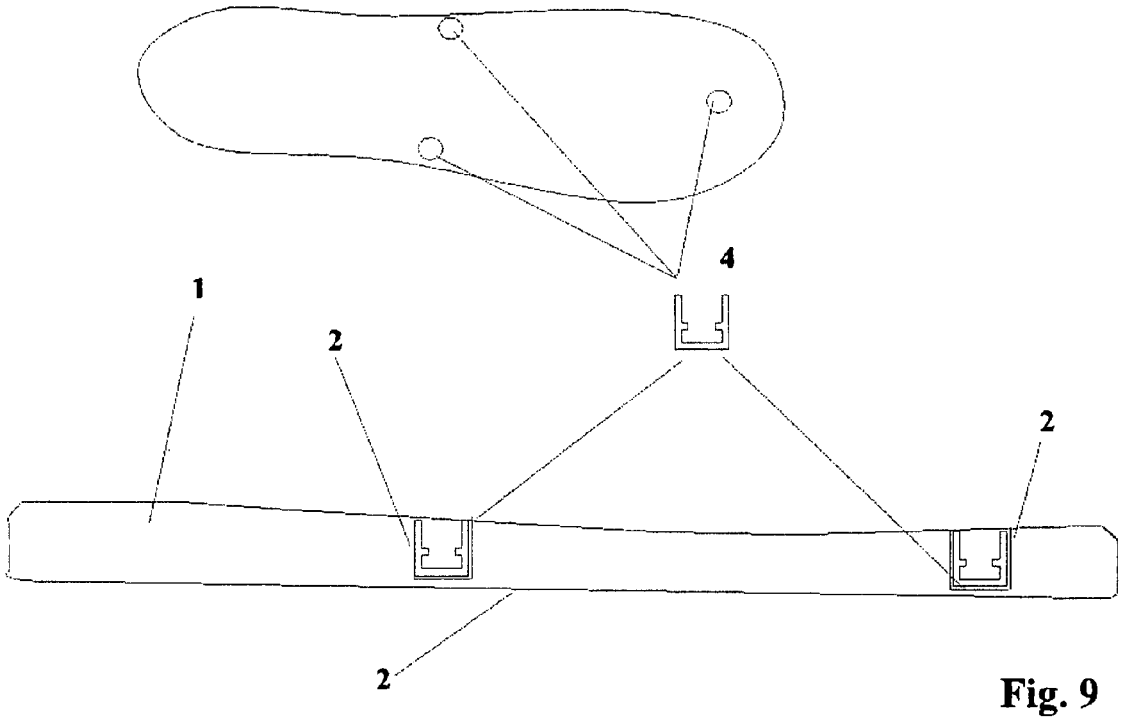
FIG. 9 is a top and a side cross-sectional view of a simplified sandal configuration including three fastener systems in accordance with an example embodiment.

FIG. 9 shows a simplified version of the evolutionary interchangeable sandal utilizing a standard sandal sole within which three sealed fasteners are positioned. In FIG. 9, two of the sealed fasteners are located at about the mid point of the major axis proximate to ends of the minor axis, and the third sealed faster is located towards the front of the sandal proximate roughly centered along the minor axis. In such an example configuration, the strap may be connected between the big toe and the fourth toe, as well as at either side of the bridge of the wearer's foot proximate to the ankle.

Figure 10:
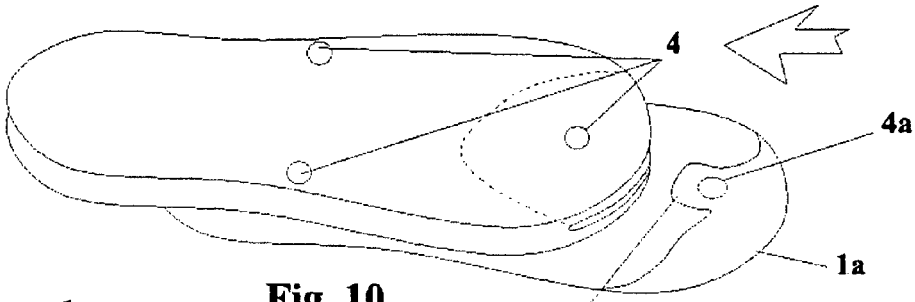
FIG. 10 and FIG. 11 include a cross-sectional and perspective view of a sole base equipped with interchangeable tread or a sole height enhancer and its holding mechanisms in accordance with an example embodiment
Figure 11:
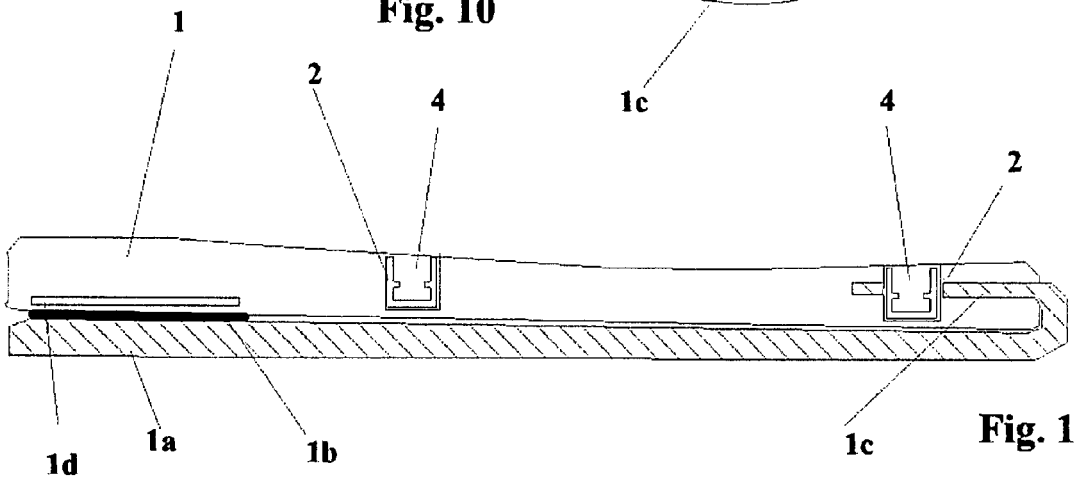

In FIGS. 10 and 11, an exemplary configuration of the evolutionary interchangeable sandal including an interchangeable tread or sole height enhancer is shown. In this illustrative configuration, the tread can be positioned through inserts within the sole base 1 (not shown in the figure) and may be secured by the combination of a locking fastener in the front of the sandal by inserting the locking fastener structure 4 through the tread portion 1*a* via locking port 4*a*. In this case, a portion 1*c* of the tread 1*a* may be inserted within the body of sole base 1 and kept in a locked position by the front locking fastener. The back portion of tread 1*a* is kept in place by the locking and positioning actions exerted by inserts (not shown in the figure) within sole base 1, and a magnetic strip 1*b* is magnetically attracted to a metal plate 1*d* embedded within sole base 1 and reduces the chances of back portion of tread 1*a* from flapping or coming lose.

In view of the above description, it will be appreciated that one or more of the following features may be incorporated into an example embodiment. In certain example embodiments, a sandal may comprise two distinct unassembled forms which, when assembled, create a functional sandal. The complete sandal assembly may include an additional sole enhancement that provides for tread or height variances.

These example forms may include a platform sole base, a strap assembly, and/or a tread/height enhancer assembly. They may be joined by fasteners comprising a male assembly in the strap form and the female assembly included in the platform or sole assembly form. The sole assembly may have the female receiving end of the connection assembly fastener integrated into the form itself, and the strap assembly may have the male connection fastener integrated into its form.

The platform sole base may be customized to various thicknesses and unique sandal sizes. The platform sole base may incorporate the female connector to provide a secure, releasable connector used to facilitate the complete sandal assembly.

The strap form may incorporate a male connector which will provide an insertable interlocking connector which may be disconnected and reconnected by the consumer as needed.

The interlocking male and female connecting device may be fully integrated into each separated platform sole base and strap assembly form. The interlocking male and female connecting device may be manufactured from any suitable material which allows for the required connection to occur. The two or three distinct unassembled forms may be manufactured from any suitable material.

The strap assembly may include any number of straps, and each may incorporate a male fastener contained at the end of the separated strap end. The platform sole base assembly may include any number of female receiving fasteners to accommodate the joining strap assembly.

The platform sole and strap assemblies may incorporate magnets within their respective forms. The magnetic devices incorporated within the platform sole and strap assemblies may be utilized to enhance the fasteners effectiveness. The magnetic devices incorporated within the platform sole and strap assemblies may be utilized as a therapeutic device.

The male and female connection devices incorporated within the sole base and the strap assemblies may have quick release mechanisms. The male and female connection fasteners incorporated within the sole base and the strap assemblies may have characteristics of a male/female screw assembly.

The fastener system may incorporate a seal thus making the inner workings of the fasteners substantially impervious to water, sand, dust, and/or other debris.

The fastener system may incorporate a dampening system formed from flexible material such that it executes a substantially water-tight seal within the locking pins and at the same time provides for an upward spring action utilized for added connective strength. The fastener system may be formed in any geometric shape to accommodate various strap assemblies The sole assembly may include receiving channels to accommodate the tread or sole height enhancement assembly. The sole assembly may include any number of locking fasteners to accommodate the tread or sole height enhancement assembly. The strap assembly may be adjustable to accommodate various foot widths as desired.

Figure 12:
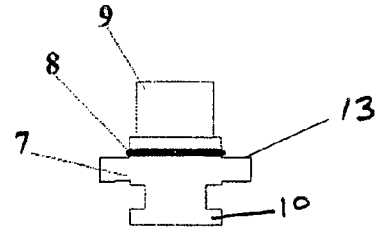
FIGS. 12 and 13 are schematic illustrations showing elements of further alternative fastener systems and their positioning within the sole base in accordance with an example embodiment; and, FIGS. 14-16 show the addition of optional support pieces that may be incorporated into the sandal to increase stability, in accordance with an example embodiment.
Figure 13:
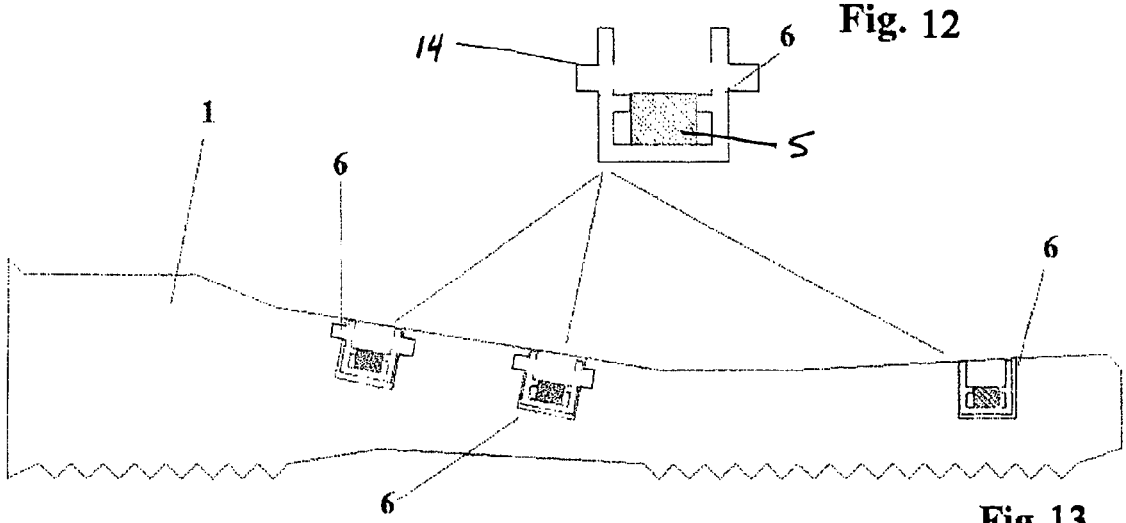

FIGS. 12 and 13 are schematic illustrations showing elements of further alternative fastener systems and their positioning within the sole base in accordance with an example embodiment. In order to increase the stability of the special fasteners and to provide for a narrower connection, it is possible to incorporate a wing-type special fastener assembly in the front and/or rear strap connections, as shown in FIGS. 12 and 13. This wing-type special assembly incorporates all the features of the previously described fastener, and further includes an additional wing projection 13 located between the screw assembly (e.g., at the bottom of the fastener) and the sealing ring assembly 8. The female or receiving assembly of the fastener unit incorporated within the platform sole will accommodate the male wing-type special fastener as shown in FIG. 12, e.g., by having receiving channels 14 formed therein above the locking pin provisions 11. This special fastener also may use the attachment motion needed to connect a male/female screw assembly. The connection may be secured by either or both of the screw assembly and wing-connection method.

Figure 14:
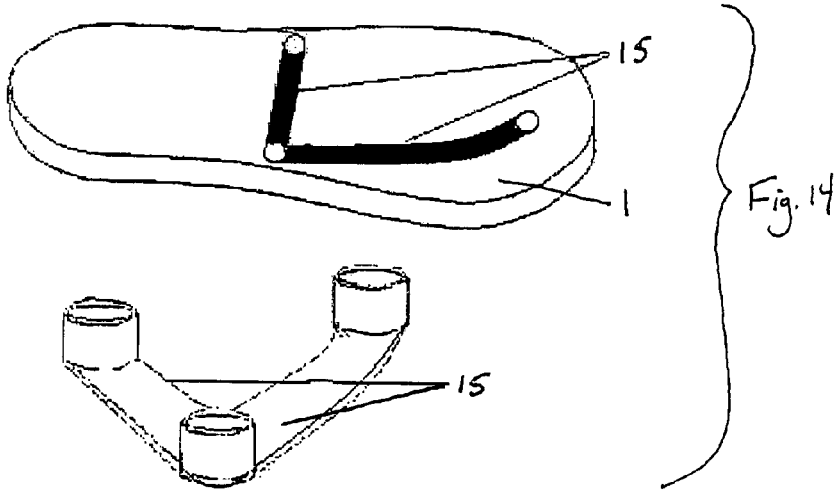
Figure 15:
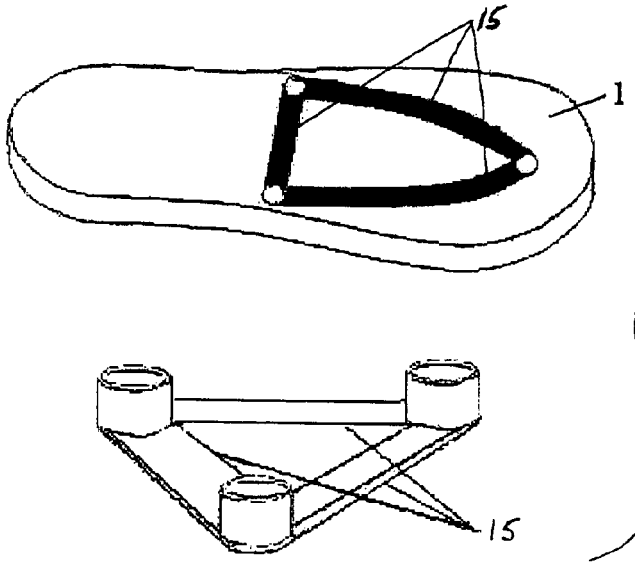
Figure 16:
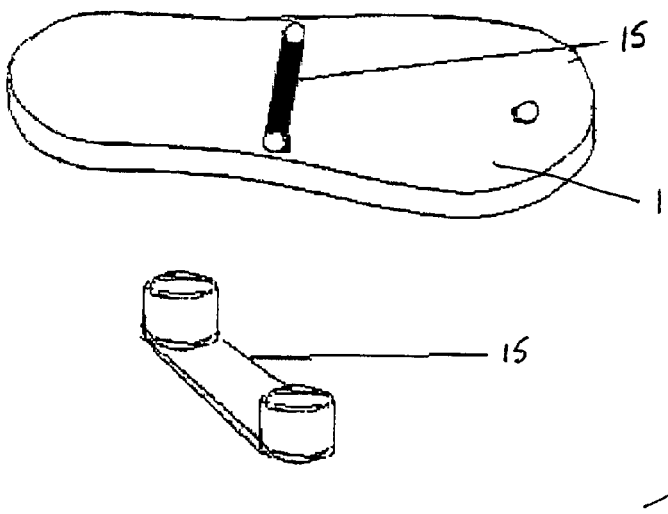

FIGS. 14-16 show the addition of optional support pieces that may be incorporated into the sandal to increase stability, in accordance with an example embodiment. To increase the stability of the special fasteners incorporated within the platform sole base 1, it is possible to optionally incorporate adjoining support pieces 15 to connect the individual fasteners within the sole platform as shown in FIG. 14-16. These adjoining support pieces 15 may be connected at any point of the special fasteners within the platform sole base. Also, they may connected to each other along one, two, or three lines, e.g., as deemed necessary for manufacturing ease and enhanced stability. FIG. 14 shows two support pieces 15 joined together, FIG. 15 shows three support pieces 15 joined together, and FIG. 16 shows a single support piece 16 being connected to the bottom of the sandal 1. It will be appreciated that the support pieces 15 may be manufactured from any suitable material, such that it is compatible with the adjoining fasteners and platform sole materials.

One or more of the first locking structure, second locking structure and/or dampening system may be substantially cylindrical in shape in certain example embodiments of this invention. However, one or more of the first locking structure, second locking structure and/or dampening system may be substantially columnar in shape in certain example embodiments of this invention. The term substantially columnar includes approximate column shapes which as viewed from above and/or below may be a cross sectional shape of a circle, oval, rectangle, square, triangle, pentagon, octagon, or any other suitable polygon or the like.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A sandal comprising:

a platform sole base including at least one positioning port formed therein;

at least one first fastener assembly, each first fastener assembly comprising:

a first locking structure, a dampening system insertable into the first locking structure, and at least two locking arms that extend inwardly into the first locking structure from the inner walls thereof, and a strap assembly including a strap and at least one second fastener assembly, each second fastener assembly comprising:

a second locking structure insertable into the first locking structure, at least two locking pins extending outwardly from the bottom of the second locking structure for rotatably engaging/disengaging with the at least two locking arms, and at least one strap receiving port for receiving the strap, and a strap locking system to cooperate with the at least one strap receiving port to secure the strap to the platform sole base, wherein each said first fastener assembly is respectively associated with one said positioning port, wherein each said first fastener assembly is respectively associated with one said second fastener assembly, and wherein the first and second fastener assemblies are suitable to removably connect the strap assembly to the platform sole base.

2. The sandal of claim 1, wherein each said positioning port is formed via machining and/or mold extrusion.

3. The sandal of claim 1, wherein each said first fastener assembly is cemented into its respective positioning port.

4. The sandal of claim 1, further comprising an o-ring seal provided to each said second fastener assembly to render the respective first and second fastener assemblies substantially impervious to water, sand, dust, and/or other debris.

5. The sandal of claim 1, wherein the strap locking system comprises a screw and vice configuration.

6. The sandal of claim 1, wherein the strap locking system is configured to adjust the length of the strap.

7. The sandal of claim 1, wherein the dampening system is formed from a flexible material so as to provide a substantially water-tight seal within the locking arms and an upward spring action for added connective strength.

8. The sandal of claim 1, further comprising at least one receiving channel formed in the platform sole base, each said receiving channel being configured to receive an interchangeable tread and/or sole height enhancer.

9. The sandal of claim 1, further comprising a metal plate and/or magnetic strip disposed within the platform sole base.

10. The sandal of claim 1, further comprising at least one wing fastener provided to the first fastener assembly proximate to the locking arms thereof; and at least one receiving channel extending outwardly from the second locking structure proximate to the locking pins for rotatably engaging/disengaging with the at least one wing fastener.

11. The sandal of claim 1, further comprising at least one support piece disposed on the bottom of the sandal, each said support piece providing support between two said first fastener assemblies.

12. A sandal, comprising:

a platform sole base including at least one positioning port formed therein;

at least one first fastener assembly, each said first fastener assembly comprising:

a first locking structure, a dampening system insertable into the first locking structure, and a substantially spiral-shaped channel formed on the first locking structure's inner surface, and a strap assembly including a strap and at least one second fastener assembly, each said second fastener assembly comprising:

a second locking structure insertable into the first locking structure, a substantially spiral-shaped groove for insertion into the channel of the at least one first locking structure, and at least one strap receiving port for receiving the strap, and a strap locking system to cooperate with the at least one strap receiving port to secure the strap to the platform sole base, wherein each said first fastener assembly is respectively associated with one said positioning port, wherein each said first fastener assembly is respectively associated with one said second fastener assembly, and wherein the first and second fastener assemblies are suitable to removably connect the strap assembly to the platform sole base.

13. The sandal of claim 12, wherein each said positioning port is formed via machining and/or mold extrusion, and wherein one or more of the first locking structure, the dampening system and the second locking structure are substantially columnar in shape.

14. The sandal of claim 12, wherein each said first fastener assembly is cemented into its respective positioning port.

15. The sandal of claim 12, further comprising an o-ring seal provided to each said second fastener assembly to render the respective first and second fastener assemblies substantially impervious to water, sand, dust, and/or other debris.

16. The sandal of claim 12, wherein the strap locking system comprises a screw and vice configuration.

17. The sandal of claim 12, wherein the strap locking system is configured to adjust the length of the strap.

18. The sandal of claim 12, wherein the dampening system is formed from a flexible material so as to provide a substantially water-tight seal within the locking arms and an upward spring action for added connective strength.

19. The sandal of claim 12, further comprising at least one receiving channel formed in the platform sole base, each said receiving channel being configured to receive an interchangeable tread and/or sole height enhancer.

20. The sandal of claim 12, further comprising a metal plate and/or magnetic strip disposed within the platform sole base.

21. The sandal of claim 12, further comprising at least one support piece disposed on the bottom of the sandal, each said support piece providing support between two said first fastener assemblies.

22. A method of making a sandal, comprising:

providing a platform sole base;

forming at least one positioning port in the platform sole base;

providing at least one first fastener assembly, each said first fastener assembly comprising a first locking structure, a dampening system insertable into the first locking structure, and at least one channel formed on the first locking structure's inner surface; and providing a strap assembly including a strap and at least one second fastener assembly, each said second fastener assembly comprising a second locking structure insertable into the first locking structure, at least one protrusion for insertion into the at least one channel of the at least one first locking structure, and at least one strap receiving port for receiving the strap;

providing a strap locking system to cooperate with the at least one strap receiving port to secure the strap to the platform sole base;

respectively associating each said first fastener with one said positioning port;

respectively associating each said first fastener assembly with one said second fastener assembly; and, removably connecting the strap assembly to the platform sole base via the first and second fastener assemblies.

* * * * *